US005231839A

United States Patent [19]

de Rijke et al.

[11] Patent Number: 5,231,839

[45] Date of Patent: Aug. 3, 1993

[54] METHODS AND APPARATUS FOR CRYOGENIC VACUUM PUMPING WITH REDUCED CONTAMINATION

[75] Inventors: Johan E. de Rijke, Cupertino; Frank W. Engle, Alameda, both of Calif.

[73] Assignee: Ebara Technologies Incorporated, Santa Clara, Calif.

[21] Appl. No.: 800,531

[22] Filed: Nov. 27, 1991

[51] Int. Cl.[5] ..... B01D 8/00

[52] U.S. Cl. ..... 62/55.5; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,137,551 | 6/1964 | Mark | 62/55.5 |
| 3,262,279 | 7/1966 | Moore, Jr. | 62/55.5 |
| 3,485,054 | 12/1969 | Hogan | 62/55.5 |
| 3,536,418 | 10/1970 | Breaux | 417/901 |
| 3,721,101 | 3/1973 | Sheppard et al. | 62/55.5 |
| 4,023,398 | 5/1977 | French et al. | 62/55.5 |
| 4,438,632 | 3/1984 | Lessard et al. | 62/55.5 |
| 4,488,506 | 12/1984 | Heinecke et al. | 62/55.5 |
| 4,599,869 | 7/1986 | Ozin et al. | 62/55.5 |
| 4,926,648 | 5/1990 | Okumura et al. | 62/55.5 |

*Primary Examiner*—Ronald C. Capossela
*Attorney, Agent, or Firm*—Stanley Z. Cole

[57] ABSTRACT

Apparatus for vacuum pumping an enclosed chamber includes a cryopump in gas communication with the chamber for removing gases by cryocondensation and cryotrapping and an auxiliary pumping device for removing gases that are difficult to remove by cryocondensation or cryotrapping. The cryopump does not contain a sorbent material for cryosorption. As a result, the potential for contamination by a sorbent material is eliminated. The auxiliary pumping device can comprise an ion pump or a turbomolecular vacuum pump. When an ion pump is used, the ion pump is inactivated during periods of high gas loading in the chamber. The vacuum pumping apparatus is particularly useful for vacuum pumping of a plasma vapor deposition chamber.

14 Claims, 1 Drawing Sheet

METHODS AND APPARATUS FOR CRYOGENIC VACUUM PUMPING WITH REDUCED CONTAMINATION

FIELD OF THE INVENTION

This invention relates to vacuum pumping of an enclosed chamber with a cryopump and, more particularly, to methods and apparatus for cryogenic vacuum pumping wherein the potential for contamination by a sorbent material is eliminated.

BACKGROUND OF THE INVENTION

Cryogenic vacuum pumps (cryopumps) are widely used in high vacuum applications. Cryopumps are based on the principle of removing gases from a vacuum chamber by having them lose kinetic energy and then binding the gases on cold surfaces inside the pump. Cryocondensation, cryosorption and cryotrapping are the basic mechanisms that can be involved in the operation of a cryopump. In cryocondensation, gas molecules are condensed on previously condensed gas molecules. Thick layers of condensate can be formed, thereby pumping large quantities of gas.

Gases that are difficult to condense at the normal operating temperatures of the cryopump can be pumped at higher temperatures by cryosorption. In this case, a sorbent material such as activated charcoal is attached to the cold surface. The binding energy between gas particles and the adsorbing particle is greater than the binding energy between the gas particles themselves, thereby causing gas particles that cannot be condensed to adhere to the sorbent material and thus be removed from the vacuum system. When several monolayers of adsorbed gas have been built up, the effect of the adsorbing surface is lost and gas can no longer be pumped.

Cryotrapping can also be used to pump gases that are difficult to condense. In this case, the sorbent material is an easily condensible gas. The sorbent gas is admitted into the pump, forming a condensate on the cold surface. The difficult to condense gas is admitted at the same time and is adsorbed on the newly formed surface of easily condensible gas. A mixed condensate is thus formed.

Cryopumps are widely used for applications where contamination by nonprocess gases such as hydrocarbons must be avoided. Cryopumps typically use a closed loop helium refrigerator. Refrigeration is produced in a first stage operating at 50° K. to 80° K. and a second stage operating at 10° K. to 20° K. Conducting metal surfaces called cryoarrays are attached to the refrigerator stages and are cooled by them. Easily condensed gases, such as water vapor, argon, nitrogen and oxygen, are pumped by cryocondensation on the first and second stage cryoarrays. However, the lowest temperature achievable in a refrigerator cooled cryopump is so high (about 10° K.) that not all gases normally present in a vacuum system can be pumped by cryocondensation. The gases which are difficult to condense, such as hydrogen, helium and neon, must be pumped by cryosorption. For this purpose, a sorbent material such as activated charcoal is attached to the second stage cryoarray. Further, only relatively low amounts of gas can be pumped by cryosorption, as only a thin layer (up to about 5 monolayers) can be formed on the surfaces.

To pump large amounts of gas, a large amount of sorbent material must be used in the pump.

Small particles of the activated charcoal can break off the surface of the cryoarray, migrate through the cryopump to the vacuum chamber and onto the surfaces of the product being processed in the system, thereby contaminating the product. The contamination problem is particularly acute in connection with small, complex circuits being developed today, when semiconductor wafers are processed in the vacuum chamber. Particles of almost any size, including very small and fine size particles, are likely to produce defects in modern microminiature devices on semiconductor wafers.

The use of ion pumps in conjunction with cryopumps to enhance cryopump performance is disclosed by J. E. deRijke, "Performance of a Cryopump Ion Pump System", *Journal of Vacuum Science and Technology*, Vol. 15, No. 2, March/April 1978, pages 765–767. A standard cryopump with sorbent charcoal on the second stage and a standard noble gas ion pump were used to increase total pumping speed and total capacity of gas that can be pumped before regeneration was needed. The disclosed configuration did not address the problem of vacuum system contamination by charcoal particles.

A turbomolecular vacuum pump having a heat exchanger located in its suction port is disclosed in U.S. Pat. No. 4,926,648 issued May 22, 1990 to Okumura et al. The heat exchanger is connected to a refrigerator through a refrigerant pipe. The refrigerant is cooled from about −100° C. to about −190° C. and is used to condense water vapor.

Tests to measure the effect of cryotrapping of hydrogen by argon in a cryopump without the use of charcoal are described by R. C. Longsworth et al, "Cryopump Vacuum Recovery After Pumping Ar and $H_2$", *J. Vac. Sci. Technol. A*, Vol. 9, No. 5, Sept./Oct. 1991, pp. 2768–2770.

A cryopump having sorption surfaces of reticulated vitreous carbon attached to the second pumping stage is disclosed in U.S. Pat. No. 4,791,791 issued Dec. 20, 1988 to Flegal et al.

It is a general object of the present invention to provide improved methods and apparatus for vacuum pumping an enclosed chamber.

It is another object of the present invention to provide methods and apparatus for vacuum pumping with a cryogenic vacuum pump wherein the potential for contamination of the vacuum chamber by a sorbent material is eliminated.

It is a further object of the present invention to provide methods and apparatus for vacuum pumping an enclosed chamber wherein a cryogenic vacuum pump is used with an auxiliary pumping device that removes gases which are difficult to remove by cryocondensation or cryotrapping.

It is a further object of the present invention to provide improved methods and apparatus for vacuum pumping a plasma vapor deposition chamber.

SUMMARY OF THE INVENTION

According to the present invention, these and other objects and advantages are achieved in methods and apparatus for vacuum pumping an enclosed chamber. Apparatus in accordance with the invention comprises a cryogenic pumping device in fluid communication with the chamber for removing gases from the chamber by cryocondensation and cryotrapping, and an auxiliary pumping device for removing gases that are difficult to remove by cryocondensation or cryotrapping. The cryogenic pumping device does not contain a sorbent material for cryosorption. As a result, the potential for contamination by a sorbent material is eliminated.

In a first embodiment of the invention, the auxiliary pumping device comprises an ion pump and means for inactivating the ion pump during periods of high gas loading in the chamber. The means for inactivating the ion pump can comprise a valve connected between the ion pump and the cryogenic pumping device. The valve is closed during periods of high gas loading in the chamber to prevent overloading of the ion pump. Alternatively, the means for inactivating the ion pump can comprise means for electrically deenergizing the ion pump during periods of high gas loading in the chamber.

In a second embodiment of the invention, the auxiliary pumping device comprises a turbomolecular vacuum pump. The turbomolecular vacuum pump can be operated continuously.

In a preferred application of the invention, the cryogenic pumping device and the auxiliary pumping device are used for vacuum pumping of a plasma vapor deposition chamber or a physical vapor deposition chamber. The cryogenic pumping device removes the argon that is normally used in the plasma vapor deposition process, and other easily condensed gases. The argon assists in cryotrapping of hydrogen from the chamber. The auxiliary pumping device removes helium and neon from the plasma vapor deposition chamber. When the auxiliary pumping device is an ion pump, the ion pump is inactivated during plasma vapor deposition to prevent overloading.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
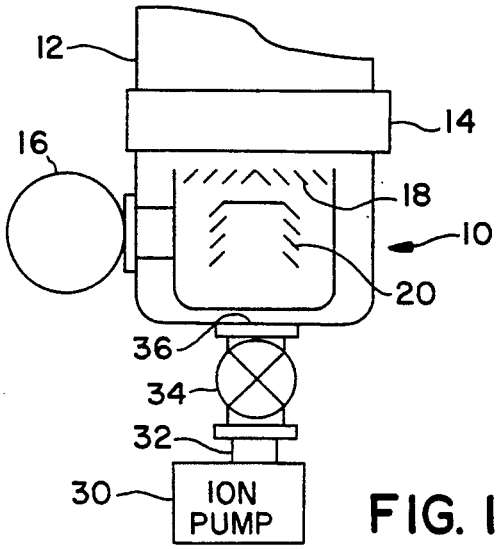
FIG. 1 is a block diagram of vacuum pumping apparatus in accordance with the invention using an ion pump connected through a valve to a cryopump.

Vacuum pumping apparatus in accordance with the present invention is shown in FIG. 1. A cryopump 10 has an inlet attached to a vacuum chamber 12 through a high vacuum valve 14. The vacuum chamber 12 (shown partially in FIG. 1) is capable of maintaining high vacuum and is typically used for performing vacuum processing of a workpiece. The cryopump 10 includes a refrigerator 16 in thermal contact with a first stage cryoarray 18 and a second stage cryoarray 20. The construction of cryopumps is well known in the art. The cryopump 10 can be a standard commercially available cryopump, such as a Model FS-8LP, manufactured and sold by Ebara Technologies Incorporated, with the modifications described below. One important modification is that the cryopump 10 does not include a solid sorbent material such as activated charcoal for vacuum pumping by cryosorption. The cryopump 10 can employ a condensed gas as a sorbent material for cryotrapping because the condensed gas does not produce contamination of vacuum chamber 12.

An ion pump 30 is connected through a suitable conduit 32 and an isolation vacuum valve 34 to cryopump 10. A standard cryopump is further modified by providing a port 36 for attachment of the vacuum valve 34 and the ion pump 30. The ion pump 30 can, for example, be a getter ion pump such as a Model NP-011, manufactured and sold by Thermionics Laboratories, Inc. The ion pump 30 is an auxiliary pumping device that partially performs the function that was performed by activated charcoal in prior art cryopumps.

The cryopump 10 removes easily condensed gases, such as water vapor, argon, nitrogen and oxygen, from the vacuum chamber 12 by cryocondensation. Depending on the gases present in vacuum chamber 12, the cryopump 10 can also remove gases by cryotrapping. For example, when argon is present in vacuum chamber 12, the argon is condensed by cryopump 10, and hydrogen is removed from vacuum chamber 12 by cryotrapping on the condensed argon.

The ion pump 30 removes gases that are difficult to condense at the operating temperatures of the cryopump 10. Examples of such gas include helium, hydrogen and neon. The vacuum valve 34 is used to isolate the ion pump 30 from vacuum chamber 12 during periods of high gas loading in vacuum chamber 12. For example, as described below, argon is used in plasma vapor deposition to form a plasma. The argon would overload the ion pump 30. Accordingly, the vacuum valve 34 is closed during plasma vapor deposition.

The vacuum pumping apparatus shown in FIG. 1 can be used, for example, in plasma vapor deposition or physical vapor deposition and is particularly useful for applications where it is required that large quantities of argon be vacuum pumped to create a flow of argon through the vacuum chamber 12. The argon is condensed on the second stage 20 of the cryopump 10. The argon condensate is used to remove hydrogen that is produced as a result of the vapor deposition process. The hydrogen is cryotrapped on the condensed argon, thereby keeping the partial pressure of hydrogen low. The hydrogen pressure must be low in order to maintain a high quality deposit on the workpiece.

Small amounts of helium and neon that diffuse into vacuum chamber 12 and are present in the process gas, are not removed by cryocondensation or cryotrapping in the cryopump 10. As indicated above, the cryopump 10 does not utilize a sorbent material for cryosorption. Although the helium and neon are inert, nonreactive gases and do not affect the quality of the deposit, these gases contribute to the measured pressure in vacuum chamber 12. It cannot be determined from the pressure reading whether the gases in the chamber include undesirable species. Thus, the helium and neon are removed by the ion pump 30.

During plasma vapor deposition, the vacuum valve 34 is closed, since pressures inside the system and the cryopump 10 are too high for proper operation of ion pump 30. The deposition is periodically suspended to permit the pressure in the vacuum chamber 12 and the cryopump 10 to drop to a level at which the ion pump 30 can be operated. The vacuum valve 34 is then opened, and the ion pump 30 removes the buildup of helium and neon from the system in a relatively short time (typically one minute or less). The vacuum valve 34 is then closed so that deposition can be resumed. It will be understood that the ion pump 30 can continuously pump vacuum chamber 12 in cases where the pressure level in chamber 12 is sufficiently low for operation of ion pump 30.

Figure 2:
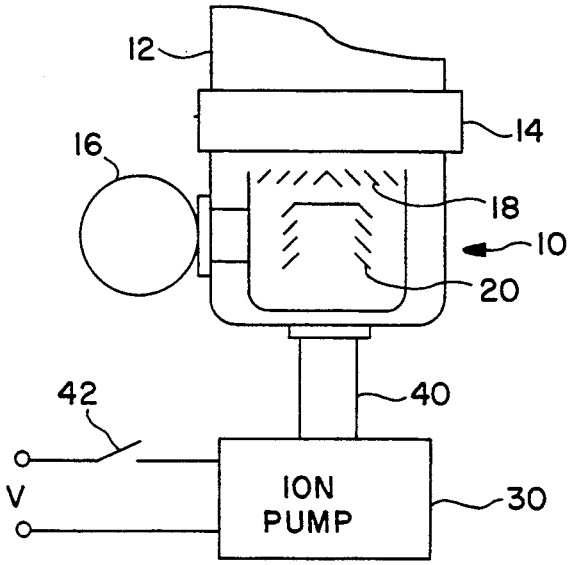
FIG. 2 is a block diagram of vacuum pumping apparatus in accordance with the invention wherein an ion pump is electrically deenergized during periods of high gas loading.

A second embodiment of the invention is shown in FIG. 2. As described above, the cryopump 10 is connected to vacuum chamber 12 through high vacuum valve 14. The cryopump 10 does not include a sorbent material such as activated charcoal for cryosorption. The ion pump 30 is directly connected to cryopump 10 through a conduit 40. An operating voltage V applied to ion pump 30 through a switching device 42 The switching device 42 provides an alternate technique for inactivating ion pump 30 during periods of high gas loading. Thus, for example, during plasma vapor deposition, the switching device 42 is opened. Since electrical energy is not applied to ion pump 30 with switching device 42 open, the ion pump 30 is inoperative. The switching device 42 is closed during periods when plasma vapor deposition is suspended to permit pumping of helium and neon as described above. It will be understood that the switching device 42 can be manually or automatically controlled.

Figure 3:
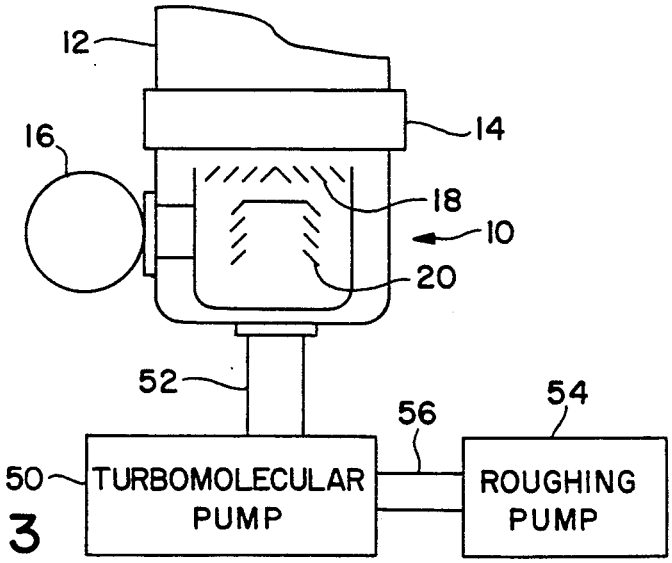
FIG. 3 is a block diagram of vacuum pumping apparatus in accordance with the invention using a turbomolecular vacuum pump connected to a cryopump.

A third embodiment of the invention is shown in FIG. 3. The cryopump 10 is connected through high vacuum valve 14 to vacuum chamber 12. The cryopump 10 does not include a sorbent material for cryosorption. A turbomolecular vacuum pump (turbopump) 50 is connected through a conduit 52 to cryopump 10. A roughing pump 54 is connected to turbopump 50 through a conduit 56. The turbopump 50 is used to remove gases that are not removed by cryocondensation or cryotrapping in cryopump 10. The roughing pump 54 is used for backup of turbopump 50, since turbopumps are typically unable to exhaust to atmospheric pressure. Suitable turbopumps and roughing pumps are known in the art and are commercially available. For example, the turbopump 50 can be a Model ET 300, available from Ebara Corporation of Japan, and the roughing pump 54 can be a Model 50 x 20 UERR6M, available from Ebara Corporation. The turbopump 50 and the roughing pump 54 can be operated continuously, such as during plasma vapor deposition, since overloading is unlikely.

Measurements have been made with an Ebara low profile 8 inch cryopump designed for sputtering applications. The auxiliary pumping device was a Model NP-011 ion pump from Thermionics Laboratories, Inc., which provided 11 liters per second nitrogen pumping speed. No valve was used between the ion pump and the cryopump. The basic test was to flow gas at 100 sccm with the ion pump off for seven hours each day. Then the gas flow was discontinued, the ion pump was turned on and a pressure measurement was taken. The base pressure was measured the following morning before starting gas flow. Up to 500 standard liters of argon have been pumped. Five standard liters of hydrogen have been cryotrapped on the argon. This is known because a gas mixture comprising 99% argon and 1% hydrogen was used.

The initial base pressure without gas on the pump, as measured with an ion gage, was $1\times10^{-8}$ torr. The indicated partial pressure of hydrogen was in the $10^{-9}$ torr range as measured with a residual gas analyzer (RGA). The indicated helium partial pressure was below $1\times10^{-11}$ torr as measured with the RGA.

After flowing, 346.5 liters of argon and 3.5 liters of hydrogen, the base pressure was $3\times10^{-7}$ torr, with hydrogen partial pressure in the $10^{-8}$ torr range and helium partial pressure still below $1\times10^{-11}$ torr. The base pressure after flowing 495 liters of argon and 5 liters of hydrogen reached $7\times10^{-7}$ torr. Due to a technical problem, RGA partial pressures were not obtained. The pump became saturated and after that, during gas flow, the pressure rose and would not come down after shutting off gas flow, requiring that the pump be regenerated.

In summary, the configuration including the cryopump and the ion pump ran for more than 80 hours before regeneration was necessary and kept the system clean without charcoal. Every eight hours we recycled by shutting off the gas flow, turning on the ion pump and pumping away the helium. By doing this overnight (the removal of helium actually only takes a few minutes), satisfactory performance of the present invention has been demonstrated during a normal work day.

Thus, the present invention provides methods and apparatus for vacuum pumping wherein the potential for contamination by a sorbent material used in a cryopump is eliminated. The gases that would normally be removed by cryosorption (on the second stage sorbent material) are vacuum pumped by cryotrapping and by an auxiliary pumping device such as an ion pump or a turbomolecular vacuum pump. As a result, equivalent vacuum pumping performance is maintained, and the potential for contamination is eliminated.

While there have been shown and described what are at present considered the preferred embodiments of the present invention, it will be obvious to those skilled in the art that various changes and modifications may be made therein without departing from the scope of the invention as defined by the appended claims.

What is claimed is:

1. Apparatus for vacuum pumping an enclosed chamber, comprising:

a cryogenic pumping device having first and second stage cryoarrays, said pumping device adapted to be in fluid communication with said chamber for removing gases from the chamber by cryocondensation and cryotrapping, said cryogenic pumping device being free of sorbent material for cryosorption;

mechanical refrigeration means for cooling said first and said second stage cryoarrays; and an auxiliary pumping device in fluid communication with said cryogenic pumping device for removing from said cryogenic pumping device gases that are normally removed by cryosorption.

2. Apparatus as defined in claim 1 wherein said auxiliary pumping device comprises an ion pump.

3. Apparatus as defined in claim 2 wherein said auxiliary pumping device further comprises means for inactivating said ion pump during periods of high gas loading in said cryogenic pumping device.

4. Apparatus as defined in claim 3 wherein said means for inactivating comprises a valve connected between said ion pump and said cryogenic pumping device, said valve being closed during periods of high gas loading in said cryogenic pumping device.

5. Apparatus as defined in claim 3 wherein said means for inactivating comprises means for electrically deenergizing said ion pump during periods of high gas loading in said cryogenic pumping device.

6. Apparatus as defined in claim 1 wherein said auxiliary pumping device comprises a turbomolecular vacuum pump connected to said cryogenic pumping device.

7. Apparatus for vacuum pumping a plasma vapor deposition chamber, comprising:

a cryogenic pumping device having a first and a second stage, said pumping device adapted to be in fluid communication with said chamber for removing argon and other gases from the chamber, said cryogenic pumping device being free of sorbent material for cryosorption;

mechanical refrigeration means for cooling said first and second stages; and an auxiliary pumping device in fluid communication with said pumping device for removing helium and neon from said pumping device.

8. Apparatus as defined in claim 7 wherein said auxiliary pumping device comprises an ion pump and means for inactivating said ion pump during plasma vapor deposition in said cryogenic pumping device.

9. Apparatus as defined in claim 8 wherein means for inactivating comprises means for electrically deenergizing said ion pump during plasma vapor deposition in said chamber.

10. Apparatus as defined in claim 7 wherein said auxiliary pumping device comprises a turbomolecular vacuum pump connected to said cryogenic pumping device.

11. A method for vacuum pumping a plasma vapor deposition chamber, comprising the steps of:

cooling to cryogenically pumping temperatures the first and second stages of a cryogenic pump;

cryogenically pumping gases from said chamber with said cryogenic pump, said pump being free of sorbent material for cryosorption;

mechanically cooling said first and second stage to cryogenic pumping temperatures; and pumping helium and neon from said pump with an auxiliary pumping device.

12. A method as defined in claim 11 wherein the step of pumping helium and neon from said chamber includes suspending plasma vapor deposition and pumping helium and neon with an ion pump when plasma vapor deposition is suspended.

13. A method as defined in claim 12 further including the step of electrically deenergizing said ion pump during plasma vapor deposition.

14. A method as defined in claim 11 wherein the step of pumping helium and neon from said pump is performed with a turbomolecular vacuum pump.

* * * * *